United States Patent [19]

Andersen

[11] Patent Number: 4,705,428

[45] Date of Patent: Nov. 10, 1987

[54] WAVE GENERATING APPARATUS

[76] Inventor: Per F. Andersen, Hummeltoften 14, 2830 Virum, Denmark

[21] Appl. No.: 837,406

[22] Filed: Mar. 7, 1986

[30] Foreign Application Priority Data

Mar. 8, 1985 [CA] Canada ..... 476134

[51] Int. Cl.[4] ..... E02B 3/00

[52] U.S. Cl. ..... 405/79; 4/491

[58] Field of Search ..... 405/79, 52, 76; 4/491

[56] References Cited

U.S. PATENT DOCUMENTS 2,002,043 5/1935 Price ..... 4/491

3,350,724 11/1967 Leigh ..... 4/491

*Primary Examiner*—David H. Corbin

*Attorney, Agent, or Firm*—Christie, Parker & Hale

[57] ABSTRACT

A machine for making (gravity) waves on the free surface of a body of water comprises a platform for machinery having a deck level which is raised above the surface of the water, driving machinery located on the platform for generating reciprocating hoist action, a weighted paddle blade suspended below the surface of the water in a horizontal attitude alongside the machinery platform, suspension means extending from the driving machinery to the weighted paddle blade for imparting vertical oscillations to the paddle blade while maintaining the generally horizontal attitude of the paddle blade.

17 Claims, 6 Drawing Figures

WAVE GENERATING APPARATUS

FIELD OF THE INVENTION

This invention relates to wave generating machines.

DESCRIPTION OF THE PRIOR ART

The usefullness of machine generated wave action for ice management in harbours and waterways was disclosed in my U.S. Pat. No. 3,477,233.

The above patent, as well as U.S. Pat. No. 4,201,496 dealt with wave making machinery which would be afloat during wave making operations and therefore would readily adjust to water level changes caused by tide and wind piling.

SUMMARY OF THE INVENTION

The present invention deals with wave making machines that need not be water borne to perform during water level changes but will nontheless perform satisfactorily within a fair range of water levels.

The invention provides wave making apparatus for deployment adjacent a body of water and for generating wave motions in the body of water, comprising shore-mounted means for generating a vertical reciprocating motion above the body of water; horizontal paddle means for deployment in the body of water adjacent the generating means; and means for suspending the paddle means from the generating means, whereby operation of the generating means causes vertical travel of the paddle means to generate wave motion.

DRAWINGS

The invention will be more clearly understood after reference to the following detailed specification read in conjunction with the drawing wherein.

DESCRIPTION OF THE PREFERRED EMBODIMENTS

Figure 1:
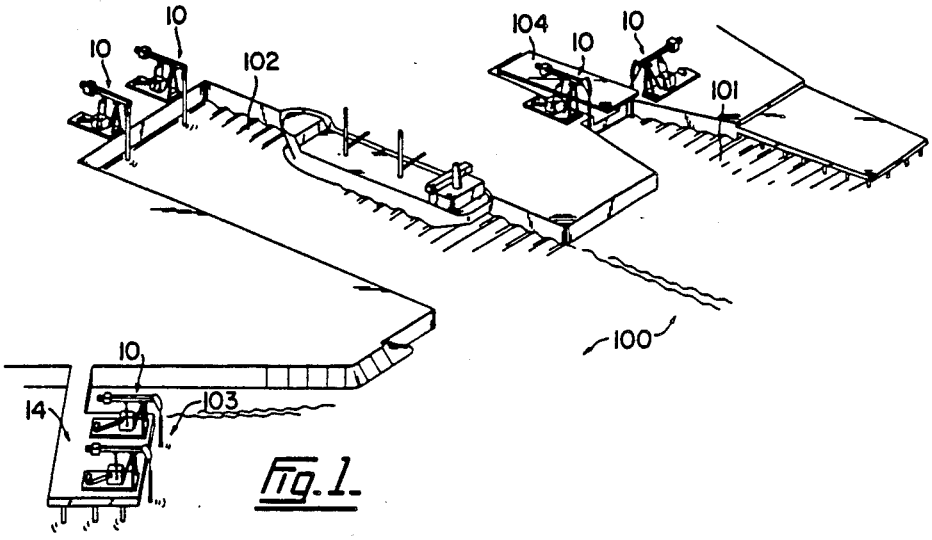
FIG. 1 is a perspective view of a harbour environment showing installations of wave making machines according to the invention.

In respect to the drawings certain reference numerals will apply in general as follows:

The numeral 10 refers to a wave making machine constructed in accordance with the invention.

The numeral 11 refers to a plunging device encompassing the portions of the wave machine which extrude below water level.

The numeral 12 refers to the driving machinery of the wave making machine in general.

The numeral 13 refers to upper suspension means for the plunging device.

The numeral 14 refers to the platform structure required for supporting the driving machinery.

The numeral 15 refers to a back board structure required for generation of one-directional wave action.

Furthermore like numerals have been used throughout the description for like parts.

Referring now to FIG. 1 showing a harbour with typical harbour features, the installation of wave machines 10 according to the invention at the head of a car ferry slip 101 behind the leading edge of the transfer bridge 104 will make it possible to generate a wave train extending from the head of the slip seawards, thereby preventing ice buildup in the slip and allowing accurate berthing of ferry ships to take place in the slip.

Similarly the installation of wave machines 10 at the head of a harbour basin 102 will make it possible to control ice conditions in the harbour basin. The installation of wave machines 10 at a harbour location 103 not in the roads can be useful in controlling ice conditions in certain harbour areas, for example the harbour extrance area if covered by the generated wave train.

Figure 2:
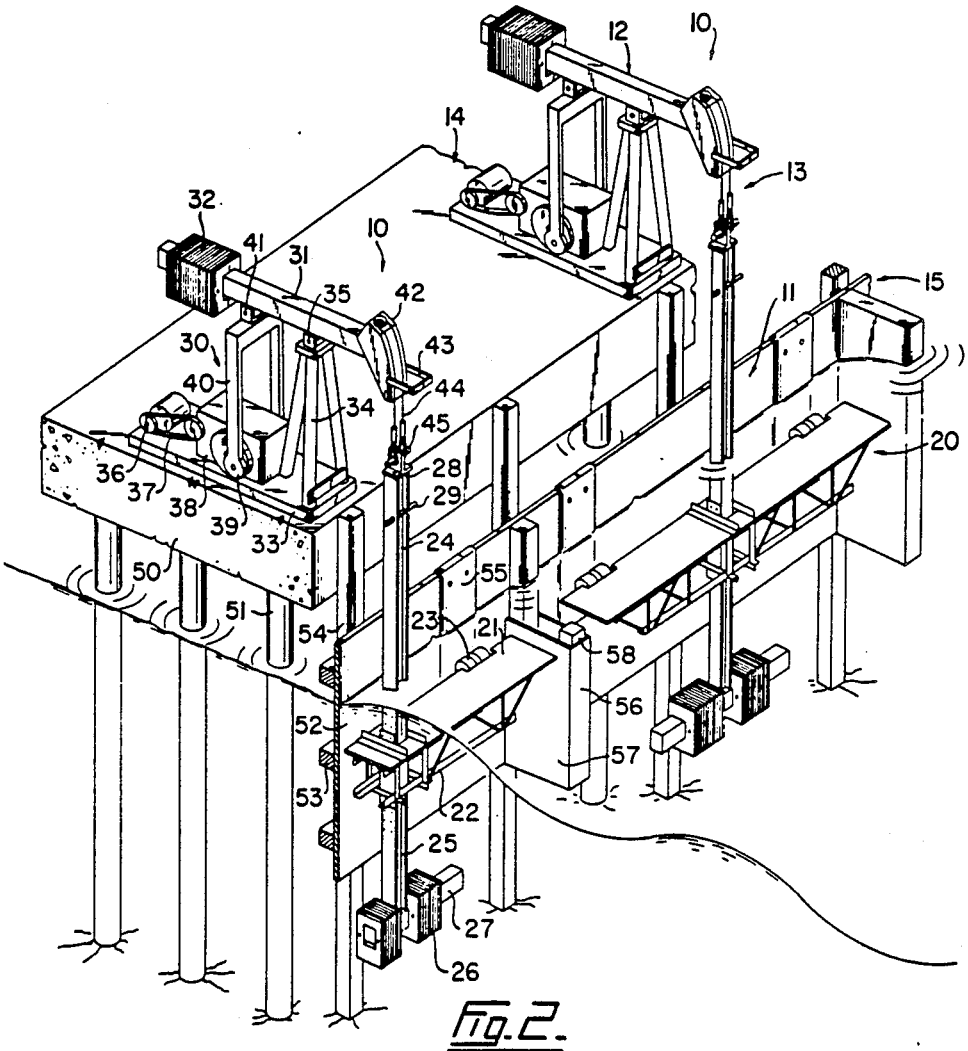
FIG. 2 is a perspective view of two identical wave making machines, according to a first embodiment of the invention, in use.

FIG. 2 shows two identical wave machines. Each machine 10 has a plunging device 11 and driving machinery 12, upper suspension means 13, platform structure 14 and backboard structure 15.

The plunging device 11 comprises a paddle blade assembly 20 made up of a blade plate 21 and a supporting blade truss 22.

The paddle blade assembly 20 is supported by an upper blade stem 24. The upper blade stem is fixed relative to the paddle blade by being bolted to the blade truss 22. Ballast 26 is secured to the ballast support beam 27 attached to the lower end of the lower blade stem 25 so that the ballast will be located below the paddle blade. The upper blade stem is capped by a carrier bracket 28. A lifting bolt 29 has also been attached to the upper end of the blade stem to serve during the installation of the wave machine. To protect the paddle blade during wave making operations and to retain its lateral orientation the paddle blade assembly is equipped with wing bumpers 23 facing the back board structure 15.

The driving machinery 12 is a beam unit mounted on a base plate 33 and includes a reciprocating drive mechanism 30, samson post 34 with centre bearing 35, walking beam 31 with counter weight 32 and horse head 42.

The reciprocating drive mechanism 30 comprises a prime mover 36, drive belt 37, double reduction gear 38, crank 39 and connecting rods with cross beam 40 and cross beam bearing 41 which conveys seasaw motion to the walking beam.

The upper suspension means 13 comprises a wireline sling 44 extending from the horsehead 42 of the driving machinery to a pin 45 attached to the carrier bar 28 of the plunging device. A bracket 43 attached to the horsehead guards the wire line sling 44 against misalignment.

The platform structure 14 comprises pilings 51 and a pile cap which forms the deck of the platform.

The back board structure 15 comprises a back board 52 supported by vertical piling 54 and horizontal brace members 53. Rubbing plates 55 aligned with the wing bumpers 23 is attached to the back board.

When the prime mover is operating, the driving machinery will produce a pumping action causing vertical reciprocating motion of the plunging device and the resulting perpendicular oscillation of the paddle blade will generate wave action. Whereas the upstroke of the plunging device is powered the force for the downstroke is delivered by the plunger's own weight plus the ballast weight and it is characteristic for the invention that the suspension means, here including a wire line sling, will remain in tension at all times.

For efficient wave generation and power use it is important that the ballast is large enough to effect a rapid down stroke and that the total weight of the plunging device including the ballast is balanced by the counterweight 32.

The location of the ballast 26 well below the paddle blade tends to reduce undesirable pendulum motion of the plunging device by lowering its centre of gravity and reduced water particle motion at depth allows the ballast body to act as a stabilizing vane.

With several wave machines operating side by side in close proximity adjacent plungers having motions not in phase with each other would receive uneven drag forces and superimposed erratic motions. By installing partition structures 56 as back board projections between plungers, mutual interference between plungers can be avoided. In the arrangement shown on FIG. 2 a cutaway portion of a partition structure 56 has been shown to include a brace member 58.

Figure 3:
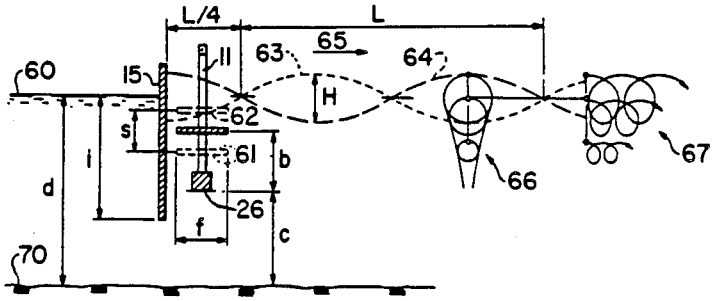
FIG. 3 is a diagrammatic illustration of the motions carried out by a wave making plunging device according to the invention and of the generated surface and sub-surface motions.

FIG. 3 shows in perpendicular section the relative position of a plunging device 11, the back board structure 15 and the free surface 60 of a water body on which waves are to be generated.

During wave making operations the plunging device 11 will carry out vertical oscillations whereby the horizontal paddle blade will oscillate between a lower position 61 and an upper position 62 and generate wave action travelling in direction 65, as also shown in FIG. 3 by consecutive wave profiles 63 and 64 roughly corresponding to paddle blade positions 61 and 62 respectively.

It is generally known that wave action will produce oscillatory particle motion in the water and 66 points to a descriptive approximation often depicted in text books showing orbital particle motions; however, actual particle traces 67 show progressive motion of water in the direction of wave travel and it will be found that the steeper the waves, the more express and thorough will be the upper layer water transportation usually called mass transport.

In addition the apparatus will provide mixing of upper water layers due to differential particle velocities with depth and it will be understood that machine generated wave action can provide long distance transportation of floating matter and effect surface mixing over very large areas.

In FIG. 3 the various dimensions and data pertaining to or affecting wave generation have been denoted by letters as follows:

d=water depth
i=depth of back board
f=width of paddle blade
l=length of paddle blade
b=depth of plunger below paddle blade
c=ballast clearance
s=stroke length
T=wave period (=crank period)
L=wave length
H=wave height
W=total weight of plunging device For a wave making machine having an elongated paddle blade of uniform width of f meters and length l meters and being part of a plunging device with a total weight of W metric tons the generation of steep waves will occur if approximately $W=0.5\ lf^2$, $s=0.5\ f$ and $T=1.7\ f^{0.5}$ seconds. The generated wave action will approximately have $L=4.7\ f$, $H=0.5\ f$ and represent a wave energy of $=0.5\ f^{2.5}\ l$ horsepower, but the prime mover of the wave making machine should be capable of energy output in suitable excess of the generated wave energy.

Both the dimensions i and d will be variables in most cases. For efficient wave generation preferably i should not fall below a value of 2 f and $d-(b+c)$ not be less than 0.25 f.

Figure 4:
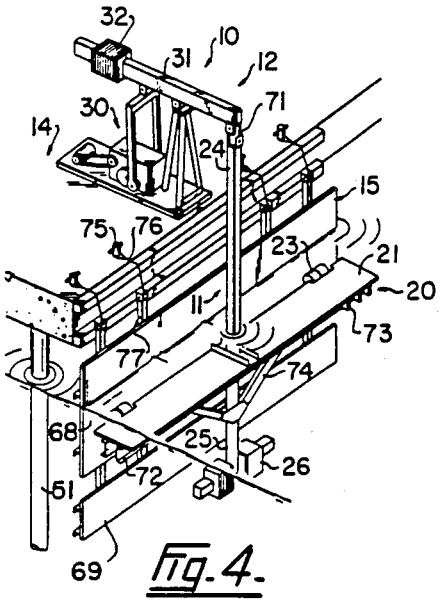
FIG. 4 is a perspective view of a wave making machine according to an alternative embodiment of the invention.

Referring now to FIG. 4 a wave making machine 10 presenting an alternative embodiment of the invention has a platform structure 14, back board structure 15, driving machinery 12 and plunging device 11. The plunging device 11 has an upper blade stem 24 and a paddle blade assembly 20 including paddle blade 21, blade support beams 72 and ribs 73, and a lower blade stem 25 supporting ballast 26 below the paddle blade. Diagonal brackets 74 complete the paddle blade assembly. The suspension means connecting the driving machinery and the plunging device here consist of a universal joint 71.

By this arrangement the motion imparted at the top of the blade stem during operations will only be approximately rectilinear. The lateral orientation of the elongation of the paddle blade is ensured by wing bumpers 23.

The back board structure 15 consists of a back board 68 and a baffle board 69 held together by brace members 77. The back board structure has been suspended from the platform structure by means of wire rope slings 76 extending from bollards 75 on the platform deck to the top of the brace members 77 of the back board. During wave making operations, the general stability of the back board will depend on the hinged support exerted by the platform structure at the top of the brace members 77 and on the resistance to perpendicular motion exerted by the weight and lateral expanse of the baffle board 69.

Figure 5:
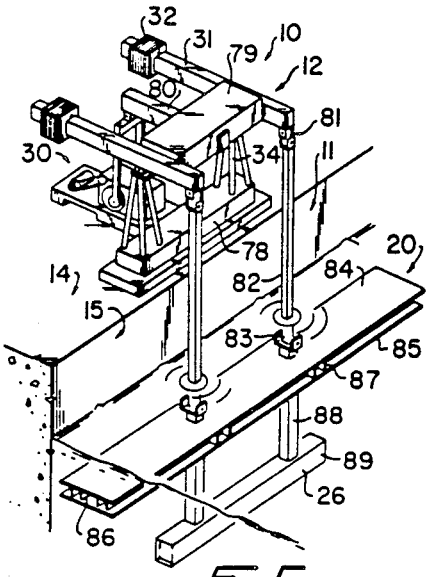
FIG. 5 is a perspective view of a wave making machine according to a further embodiment of the invention.

FIG. 5 shows a wave making machine 10 presenting a further alternative embodiment of the invention. The machine comprising platform structure 14, back board structure 15, driving machinery 12 and plunging device 11. The driving machinery 12 comprises two identical beam units mounted side by side and unified by coupling structures 78 and 79 rigidly connecting samson posts 34 and parallel walking beams 31 respectively. A single reciprocating drive mechanism 30 will operate the parallel walking beams by means of a central driving beam 80. The plunging device 11 here coinciding with the paddle blade assembly 20 consists of upper and lower blade plates 84 and 85, blade support beams 86 and ribs 87, ballast support structures 88 and ballast 26 including ballast containing case 89.

The paddle blade suspension means consists of two parallel rod hangers 82 attached to the walking beams 31 by universal joints 81 at their upper ends and at their lower ends by hinges 92 on top of the paddle blade assembly 20.

During wave making operations the horizontal orientation of the paddle blade elongation parallelling the back board is retained by the double suspension system. The back board 15 here is the face of the platform structure 14.

Figure 6:
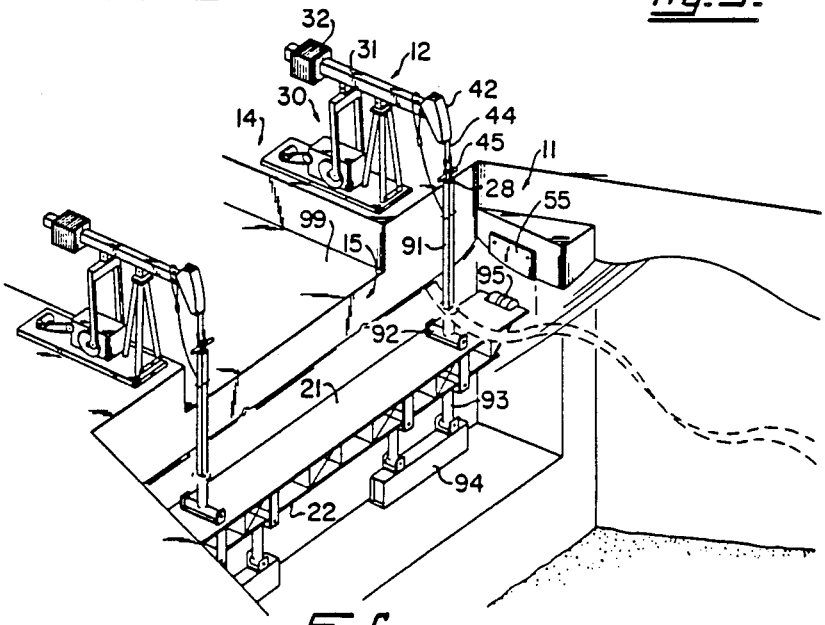
FIG. 6 is a perspective view of a wave making machine according to a still further embodiment of the invention installed at the head of a ferry slip.

FIG. 6 is a pictorial view of a wave making machine according to a still further embodiment of the invention installed at the head of a ferry slip. The machine comprises platform structure 14, back board structure 15, driving machinery 12 and plunging device 11.

The driving machinery 12 is composed of two identical beam units spaced apart and located on either side of the transfer bridge pit 99 to operate either end of the paddle blade assembly (which constitutes the plunging device 11) but having their operations synchronized so that they will operate in unison.

The transfer bridge has been omitted from the picture on FIG. 6, but its arrangement can be conceived from FIG. 1, which shows a ferry slip 101 with a transfer bridge 104, and it will be understood that the roll-on roll-off traffic will pass over the paddle blade assembly (and between the beam units).

The plunging device 11 comprises blade plate 21, blade truss 22 and two ballast cases 94 suspended from the blade truss by hinged rod hangers 93. The blade plate assembly is protected by end bumpers 95. The suspension means for the blade plate assembly consists of two identical assemblies suspended from the horse heads 42 of the driving machinery, each consisting of a wire line sling 44, carrier pin 45, carrier bracket 28 and rod hangers 91 connected to hinges 92 on top of the blade plate 21.

The arrangement of the suspension system allows the driving units to fall out of step without doing damage to the plunging device.

The coordination of the two beam units of the driving machinery can be attained by the use of synchronous electric motors and notched belt drives for both driving units assuming that both motors are powered from the same generator.

In natural waters water level changes will always occur. In inland waters such changes would often fall within the operating range of the wave making machinery of the invention or may take place over an extended period to allow for infrequent manual adjustments to the equipment.

In tidal waters intermittent operation of the wave making machinery within a limited tidal range, for example coinciding with maximum tidal outflow, might provide the most economical mode of operation.

The various embodiments of the invention presented in the foregoing have in common that the driving machinery for generating the vertical reciprocating motion is shore mounted. In existing harbours and sites of potential employment of machinery of the invention it would often be possible to incorporate existing structures to provide platform and back board facilities for the wave making machinery. In other cases the machinery must be supported and backed by specially constructed shore facilities for example piled platform structures mounted in the sea bed.

In all of the embodiments of the invention a variety of construction materials can be used. The platform structure may include structural steel, concrete and timber, the back board could be built of steel, aluminum or timber, the driving machinery would generally be made of steel and the plunging device made from steel, stainless steel or aluminum. Wing bumpers on the paddle blade assembly denoted 23 and 95 on the drawings would consist of nylon cylinders mounted on steel shafts and brackets attached to the paddle blade support truss.

The usefulness of wave making machinery of the invention for ice management in harbour and waterways have been emphasized in the foregoing but their usefulness for other purposes and in other locations where shore based wave making machinery is desirable must be recognized for example for overcoming stagnation in water reservoirs, for entertainment in swimming pools or for wave making in hydraulic studies etc.

I claim:

1. Wave making apparatus for deployment adjacent a body of water and for generating wave motions in the body of water, comprising:

shore-mounted means for generating a vertical reciprocating motion above the body of water;

horizontally oriented paddle means for complete immersion in the body of water adjacent the generating means;

ballast means attached to the horizontally oriented paddle means; and means for freely suspending the paddle means and the ballast means from the generating means, whereby generation of the generation means causes vertical travel of the paddle means and the ballast means to generate wave motion, the motion of the paddle means being moderated by the complete immersion in the body of water.

2. The apparatus defined in claim 1 further including a back board for deployment adjacent the paddle means and facing the body of water.

3. The apparatus defined in claim 2 wherein the shore-mounted means is a beam comprising a walking beam pivoted to rock about a horizontal axis and a prime mover connected by crank means to the walking beam, the suspension means being secured to the outer end of the walking beam for suspending the paddle means.

4. The apparatus defined in claim 1 wherein the ballast means are secured to the paddle means, and in which a counterweight is provided on the inner end of the walking beam.

5. The apparatus defined in claim 1 wherein the paddle means comprises a braced horizontal planar element beneath which ballast means is disposed.

6. The apparatus defined in claim 1 wherein the means for suspending the paddle means comprises a wire sling secured to a horsehead on the outer end of the walking beam, and a stem secured to the wire sling and to the paddle means.

7. The apparatus defined in claim 1 wherein the means for suspending the paddle means includes a universal joint connecting the outer end of the walking beam to a stem secured to the paddle means.

8. Wave making apparatus as claimed in claim 2 wherein the paddle means is provided with bumpers facing the back board.

9. Wave making apparatus comprising a pair of beam units as defined in claim 3 connected to a single paddle.

10. Wave making apparatus as claimed in claim 9 wherein the walking beams of the pair of beam units are connected together and are driven by a single prime mover.

11. A machine for making waves on the surface of a body of water comprising:

a platform for machinery having a deck level which is raised, above the surface of the water, and driving means located on the platform for generating reciprocating hoist action;

a backboard adjacent the platform and extending into the water;

a weighted paddle blade freely suspended and totally immersed below the surface of the water in a horizontal attitude alongside the backboard; and suspension means extending from the driving means to the weight paddle blade for imparting vertical oscillations to the paddle blade while maintaining the generally horizontal attitude of the paddle blade, said suspension means including a joint freely suspending the weighted paddle blade.

12. The apparatus defined in claim 11 where the backboard is suspended from hinges on the platform.

13. The apparatus defined in claim 11 in which the driving means comprises a beam unit counterweighted to balance the weight of the weighted paddle blade and its suspension means.

14. The apparatus defined in claim 11 in which the suspension means comprises a rigid stem perpendicular to the paddle blade with a flexible connection at the driving means and a fixed connection at the paddle blade.

15. The apparatus defined in claim 14 including bumpers on the paddle blade facing the backboard.

16. The apparatus defined in claim 11 in which the suspension means consists of twin hanger rods with flexible connections at the driving means and hinged joints at the paddle blade.

17. The apparatus defined in claim 1, wherein the ballast means are located below the horizontally oriented paddle means.

* * * * *